United States Patent [19]

Moller

[11] 4,066,257

[45] Jan. 3, 1978

[54] TREADMILL EXERCISING DEVICE

[76] Inventor: Bynum W. Moller, P.O. Box 688, Kerrville, Tex. 78028

[21] Appl. No.: 629,909

[22] Filed: Nov. 7, 1975

[51] Int. Cl.[2] ..... A63B 23/06

[52] U.S. Cl. ..... 272/69

[58] Field of Search ..... 272/69, 118, 133, 134, 272/144; 5/2 B, 6, 1

[56] References Cited

U.S. PATENT DOCUMENTS

| | | | |
|---|---|---|---|
| 931,394 | 8/1909 | Day | 272/69 |
| 2,117,957 | 5/1938 | Heller | 272/69 |
| 2,219,219 | 10/1940 | Boger | 272/134 |
| 2,255,864 | 9/1941 | Stephens | 272/73 |
| 2,632,645 | 3/1953 | Barkschat | 272/118 X |
| 3,608,898 | 9/1971 | Berlin | 272/69 |
| 3,874,657 | 4/1975 | Niebojewski | 272/144 |

*Primary Examiner*—William H. Grieb
*Assistant Examiner*—T. Brown
*Attorney, Agent, or Firm*—G. Turner Moller

[57] ABSTRACT

There is disclosed a treadmill exercising device mounted for movement between a horizontal operative position and an upright storage position. A cabinet is mounted with the treadmill so that movement of the cabinet to an upright storage position causes the treadmill to move to the upright position concealed by the cabinet. Cabinet and treadmill movement can be either independent or simultaneous.

8 Claims, 4 Drawing Figures

TREADMILL EXERCISING DEVICE

The provision of treadmill exercising devices is old and well known in the art. It will be apparent that treadmills consume a considerable amount of floorspace which, when the treadmill is not in use, is wasted. To alleviate this problem, there have been proposed treadmills which are pivotly mounted between a horizontal operative position and a vertical storage position as shown in U.S. Pat. Nos. 931,394 and 2,117,957. Also of interest in this regard is U.S. Pat. No. 3,731,917. It will be apparent that a vertical storage position of the type illustrated in the aforementioned devices leaves the treadmill exposed which would be suitable for a gymnasium or exercise room but which would not be suitable for an office, den or other living area.

In accordance with this invention, a treadmill is associated with a cabinet structure. The treadmill is pivoted between an operative position and an upright storage position. When in the storage position, the treadmill is concealed by the cabinet thereby enabling the device to be placed in an office, den or other living area without detracting from the aesthetic appearance thereof. Of interest in this regard is U.S. Pat. No. 3,042,978.

It is an object of this invention to provide a treadmill and cabinet therefor in which the treadmill is mounted between a generally horizontal operative position and an upright concealed storage position.

In summary, the exercising device of this invention comprises a treadmill and means mounting the treadmill for movement between an operative position and an upright storage position, a cabinet and means for mounting the cabinet for movement between a first position exposing the treadmill in the operative position and a second position concealing the treadmill in the upright position, the mounting means including means moving the treadmill from the operative position toward the upright position in response to cabinet movement from the first position toward the second position.

IN THE DRAWING

Figure 2:
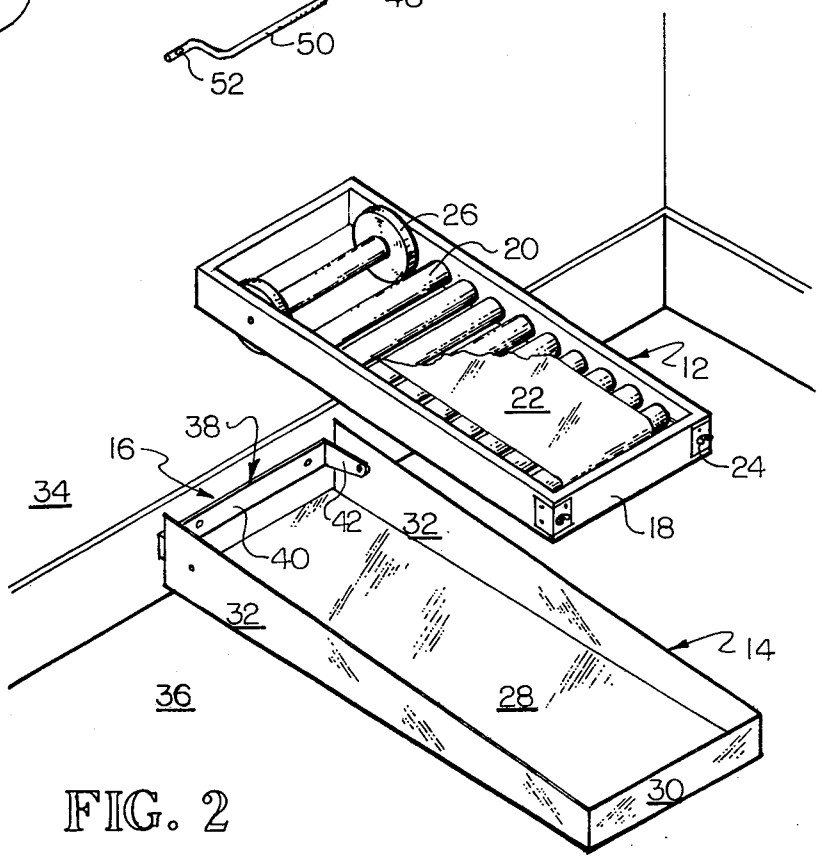
FIG. 2 is an exploded isometric view illustrating the treadmill of FIG. 1 in an operative position.
Figure 1:
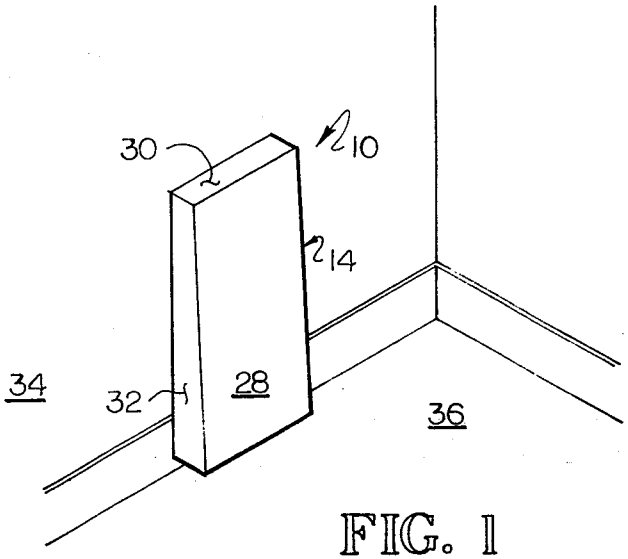
FIG. 1 is an isometric view illustrating the treadmill of this invention in an upright concealed storage position.

Referring to FIGS. 1 and 2, the exercise device 10 of this invention comprises, as major components, a treadmill 12, a cabinet or closure 14 and means 16 mounting the treadmill 12 and the cabinet 14 for movement between a generally horizontal operative position exposing the treadmill 12 for use as illustrated in FIG. 2 and an upright storage position in which the treadmill 12 is concealed as shown in FIG. 1.

The treadmill 12 may be of any suitable type and is illustrated as a device obtainable from the Snyder Manufacturing Co. of Philadelphia, Pa. and known as Model XJ-880. Such devices typically comprise a rectangular frame 18 rotatably mounting a plurality of rollers 20 about which is placed an endless belt 22. Suitable belt tension adjusting means 24 may be provided as desired. One or more flywheels 26 may be provided on one or more of the rollers 20.

The cabinet 14 is conveniently of generally rectangular configuration in front elevation as shown in FIG. 1 providing a front wall 28, a top wall 30 and a pair of tapered side walls 32. The cabinet 14 accordingly provides an open back exposing the treadmill 12 in the horizontal position of FIG. 2 and an open bottom. As is apparent from FIG. 2, the cabinet 14 is deeper at the bottom thereof to accommodate the flywheels 26.

The cabinet 14 conveniently comprises a vacuum-formed sheet of plastic material which may be textured or have thereon a design compatible with an office, den or other living area. Simulated wood grain or simulated leather plastic materials provide an extremely attractive exercise installation. As will be more fully pointed out hereinafter, the cabinet 14 may be attached to the treadmill frame 18, may be integrally formed with the treadmill frame 18 or otherwise arranged for simultaneous movement therewith. In the alternative, the cabinet 14 may be mounted for independent movement relative to the treadmill 12 away from the upright storage position.

Figure 3:
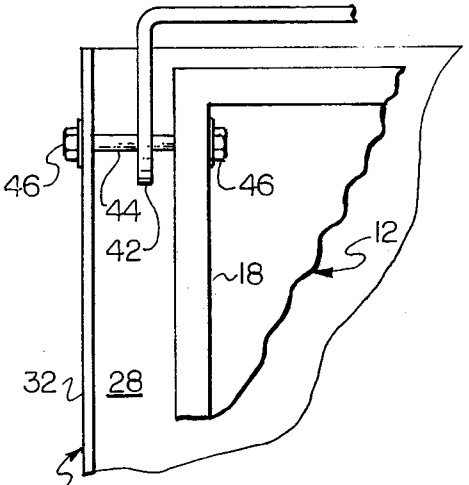
FIG. 3 is a partial top view of one embodiment of the invention illustrating the treadmill and cabinet mounted for independent movement.

As best illustrated in FIG. 2, the mounting means 16 supports the treadmill 12 and the cabinet 14 from a vertical wall 34 adjacent the juncture thereof with a floor 36 of a room. The mounting means 16 comprises a generally U-shaped bracket 38 with the bight 40 secured to the wall 34 as by nails or screws. The legs 42 of the bracket 38 extend generally perpendicularly from the wall 34. As shown best in FIG. 3, a bolt or other pivot pin 44 extends through the cabinet side wall 32, the bracket leg 42 and the treadmill frame 18. Suitable end connections 46, such as nuts or the like, complete the connection between the bracket 38, the treadmill 12 and the cabinet 14. In this embodiment of the invention, it will be apparent that the treadmill 12 is independently mounted for movement from a generally horizontal operative position in which the free end thereof is supported by the floor to the vertical storage position. It will be apparent from FIG. 2 that the treadmill 12 is slightly inclined relative to the floor 36. The term generally horizontal position is accordingly deemed to include all operative treadmill positions. After the treadmill 12 is upright, the cabinet 14 may then be pivoted to its upright position. In the alternative, grasping and pivoting the cabinet 14 from the operative position to the vertical position will cause simultaneous movement of the treadmill 12.

Referring to FIG. 2, the treadmill 12 further comprises a user support element 48 which is illustrated as a bar 50 having offset ends 52 connected to the wall 34 in any convenient fashion. It will be apparent that the bar 50 may be used as a support which may be grasped or leaned on by an exerciser while using the treadmill 12 in a conventional manner.

It will be apparent from FIGS. 1 and 2 that the pivot axis established by the pin 44 is spaced from the wall 34 a greater distance than the free end of the treadmill 12 when in the upright position. The center of gravity of the treadmill 12, when in the upright position thereof, is accordingly closer to the vertical wall 34 than the pivot axis provided by the pin 44. The treadmill 12 will accordingly remain in its upright position without the use of latching elements or the like. If so desired, however, a latch element (not shown) may be provided inside the cabinet and conveniently on the underside of the top wall 30 which engages the bar 50 to hold the treadmill 12 and cabinet 14 in the upright position.

Figure 4:
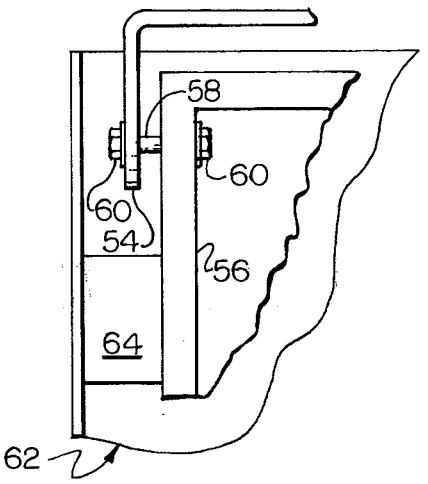
FIG. 4 is a partial top view of another embodiment of the invention illustrating the treadmill and cabinet mounted for simultaneous movement.

Referring to FIG. 4, there is illustrated another embodiment of the mounting means for mounting the treadmill and cabinet between the operative and storage positions thereof. A bracket leg 54 is juxtaposed to the treadmill frame 56 and connected thereto by a suitable fastener 58 having end connections 60 thereon. The cabinet 62 is attached to the treadmill frame 56, as by the use of a spacer or shim 64 which is adhesively bonded between the cabinet 62 and the treadmill frame 56. In the alternative, the front wall of the cabinet 62 may be adhesively bonded directly to the bottom of the treadmill frame 56. It will accordingly be seen that the embodiment of FIG. 4 provides for simultaneous movement of the cabinet and treadmill both toward and away from the generally horizontal position thereof.

It will accordingly be seen that there is herein provided an improved treadmill exercising device having all the advantages of this invention.

I claim:

1. An exercise device comprising; a treadmill; means mounting said treadmill for movement between a generally horizontal operative position and an upright storage position; a cabinet having at least one open portion; means mounting said cabinet for movement between a first position exposing said treadmill through said open portion while in said operative position and a second position concealing said treadmill when in said upright storage position; said treadmill mounting means and said cabinet mounting means including substantially horizontal axle means and means connecting said treadmill and cabinet for enabling simultaneous pivotal movement of said treadmill and cabinet about said axle means from said treadmill operative position toward said treadmill upright position in response to cabinet movement from said first position towards said second position.

2. An exercise device comprising; an endless belt treadmill; means mounting said treadmill for movement between a generally horizontal operative position and an upright storage position; a cabinet having a front wall positioned generally parallel to said endless belt for concealing said treadmill when in said storage position and an open back exposing said treadmill when in said operative position; and means for mounting said cabinet for movement between a first position exposing said treadmill in said operative position and a second position concealing said treadmill when in said upright position.

3. The exercising device of claim 2 wherein the cabinet further comprises a top wall and side walls extending from the front wall beyond the path of the endless belt.

4. An exercise device comprising, a support for attachment to a wall; a treadmill; means attaching said treadmill to said support for movement between an upright storage position and a generally horizontal operative position; a cabinet; said cabinet having a front wall spanning said treadmill and an opening opposite said front wall spanning said treadmill; and means attaching said cabinet to said support for movement between a first position concealing said treadmill in said storage position and a second position exposing said treadmill through said opening when said treadmill is in said operative position, said cabinet and treadmill being arranged to move together from said operative position toward said storage position in response to movement of said cabinet from said second position toward said first position.

5. The exercise device of claim 4 wherein the treadmill comprises a frame mounted for movement between the positions and wherein the cabinet is affixed to the frame for movement therewith.

6. The exercising device of claim 4 wherein the support comprises a bracket having a section for attachment to a vertical wall, and wherein the pivotal mounting means comprises pivot pin means passing through the bracket defining the pivot axes, the distance between the pivot axes and the bracket section exceeding the distance between the center of gravity of the treadmill in the upright position thereof and a vertical plane extending through the bracket section.

7. The exercise device of claim 4 wherein said treadmill and cabinet attaching means is a pivot pin allowing pivotal movement of said treadmill and cabinet about coaxial axes toward and away from said positions.

8. The exercise device of claim 4 wherein said treadmill and cabinet attaching means include means allowing independent pivotal movement of said treadmill and cabinet about respective axes.

* * * * *